US011211750B2

(12) United States Patent
Wu et al.

(10) Patent No.: US 11,211,750 B2
(45) Date of Patent: Dec. 28, 2021

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Tsu-Yang Wu, New Taipei (TW); Ching-Hsiang Chang, New Taipei (TW); Wei-Chou Lin, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/987,419

(22) Filed: Aug. 7, 2020

(65) Prior Publication Data

US 2021/0044060 A1 Feb. 11, 2021

(30) Foreign Application Priority Data

Aug. 7, 2019 (CN) ..... 201910723379.1

(51) Int. Cl.

| | |
|---|---|
| ***H01R 13/648*** | (2006.01) |
| ***H01R 13/6471*** | (2011.01) |
| ***H01R 13/6585*** | (2011.01) |
| ***H01R 12/72*** | (2011.01) |

(52) U.S. Cl.

CPC ..... *H01R 13/6471* (2013.01); *H01R 12/724* (2013.01); *H01R 13/6585* (2013.01)

(58) Field of Classification Search

CPC ..... H01R 12/722; H01R 12/724; H01R 13/6471; H01R 13/6585

USPC ..... 439/79, 108

See application file for complete search history.

(56) References Cited

U.S. PATENT DOCUMENTS

| | | | |
|---|---|---|---|
| 8,944,849 | B1 | 2/2015 | Yang et al. |
| 9,520,680 | B2 | 12/2016 | Hsu et al. |
| 2009/0221165 | A1 | 9/2009 | Buck et al. |
| 2016/0006182 | A1 | 1/2016 | Tyco |
| 2016/0020558 | A1 | 1/2016 | Yang |

FOREIGN PATENT DOCUMENTS

| | | | |
|---|---|---|---|
| CN | 201466406 | U | 5/2010 |
| CN | 105449417 | A | 3/2016 |
| CN | 205621919 | U | 10/2016 |
| CN | 207250764 | U | 4/2018 |
| TW | M500382 | U | 5/2015 |

*Primary Examiner* — Khiem M Nguyen

(74) *Attorney, Agent, or Firm* — Ming Chieh Chang; Wei Te Chung

(57) ABSTRACT

An electrical connector assembly includes a plug connector and a receptacle connector each equipped with a grounding bar. The plug connector includes an insulative plug housing with a mating tongue, and a plurality of stationary plug contacts retained in the plug housing. The plug contacts include a plurality of signal contacts and a plurality of grounding contacts. The grounding bar forms a set of first fingers, a set of second fingers and a set pf third fingers respectively located at different positions, to respectively contact the different three positions of the respective grounding contacts.

10 Claims, 12 Drawing Sheets

ELECTRICAL CONNECTOR ASSEMBLY

BACKGROUND OF THE INVENTION

1. Field of the Invention

The present invention relates generally to an electrical contact assembly including the mated receptacle connector and plug connector, and particularly to each of the plug connector and the receptacle connector equipped with a grounding bar mechanically and electrically connected to the corresponding grounding contacts.

2. Description of Related Arts

US publication application US20090221165 discloses using a grounding bar mechanically and electrically connected to the corresponding grounding contacts. Anyhow, the single point contacting between the grounding bar and the respective grounding contact may no longer satisfy the high speed transmission.

It is desired to provide an electrical connector equipped with the grounding bar with multiple-contact contacting between the grounding bar and the respective grounding contact.

SUMMARY OF THE INVENTION

To achieve the above object, an electrical connector assembly includes a plug connector and a receptacle connector each equipped with a grounding bar. The plug connector includes an insulative plug housing with a mating tongue, and a plurality of stationary plug contacts retained in the plug housing. The plug contacts include a plurality of signal contacts and a plurality of grounding contacts. The grounding bar forms a set of first fingers, a set of second fingers and a set pf third fingers respectively located at different positions, to respectively contact the different three positions of the respective grounding contacts. Correspondingly, the receptacle connector includes an insulative receptacle housing and a plurality of deflectable receptacle contacts retained in the receptacle housing. The grounding bar forms a set of first tangs and a set of second tangs respectively located at different positions to respectively contact the different two positions of the respective grounding contacts.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
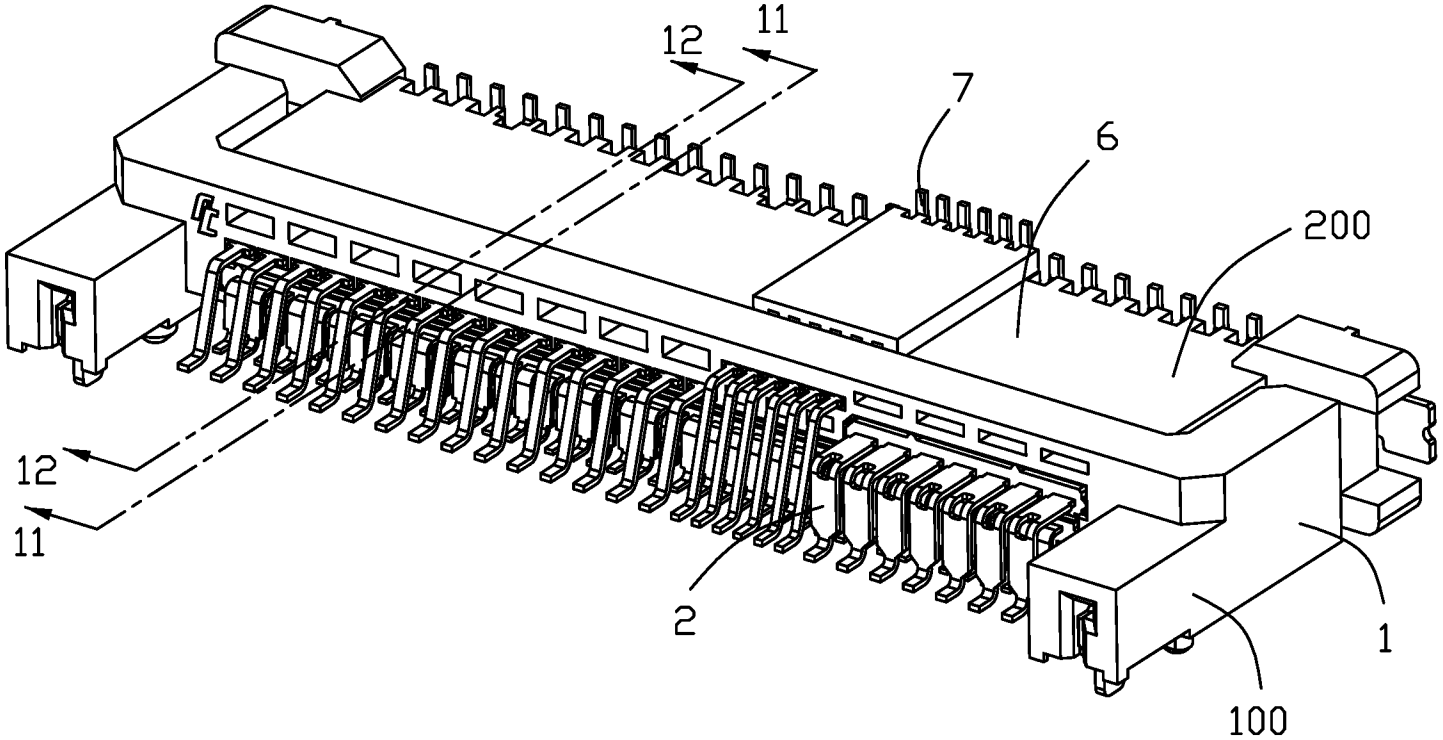
FIG. 1 is a perspective view of an electrical connector assembly including the plug connector and receptacle connector mated with each other.
Figure 2:
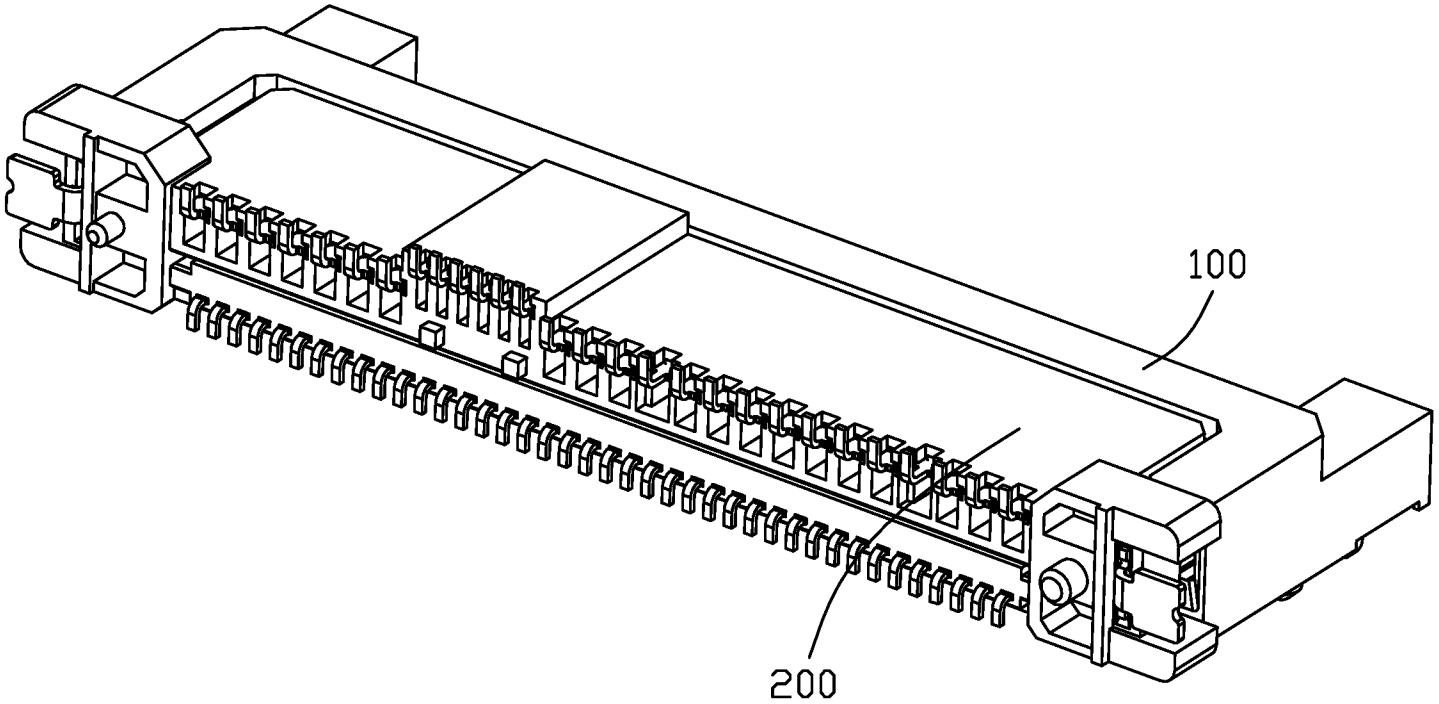
FIG. 2 is another perspective view of the electrical connector assembly of FIG. 1.
Figure 3:
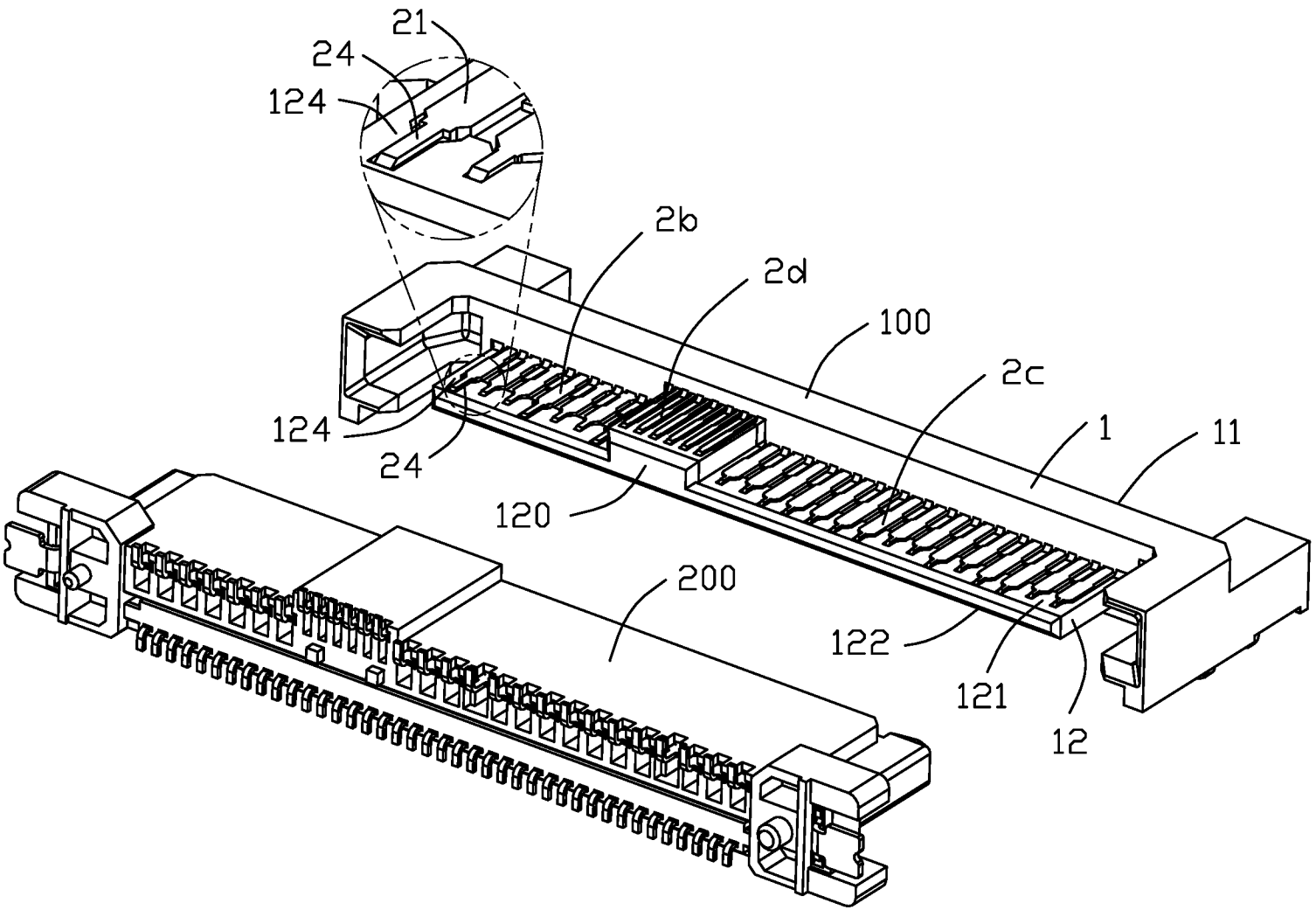
FIG. 3 is a perspective view of the electrical connector assembly of FIG. 2 wherein the plug connector and the receptacle connector are separated from each other.
Figure 4:
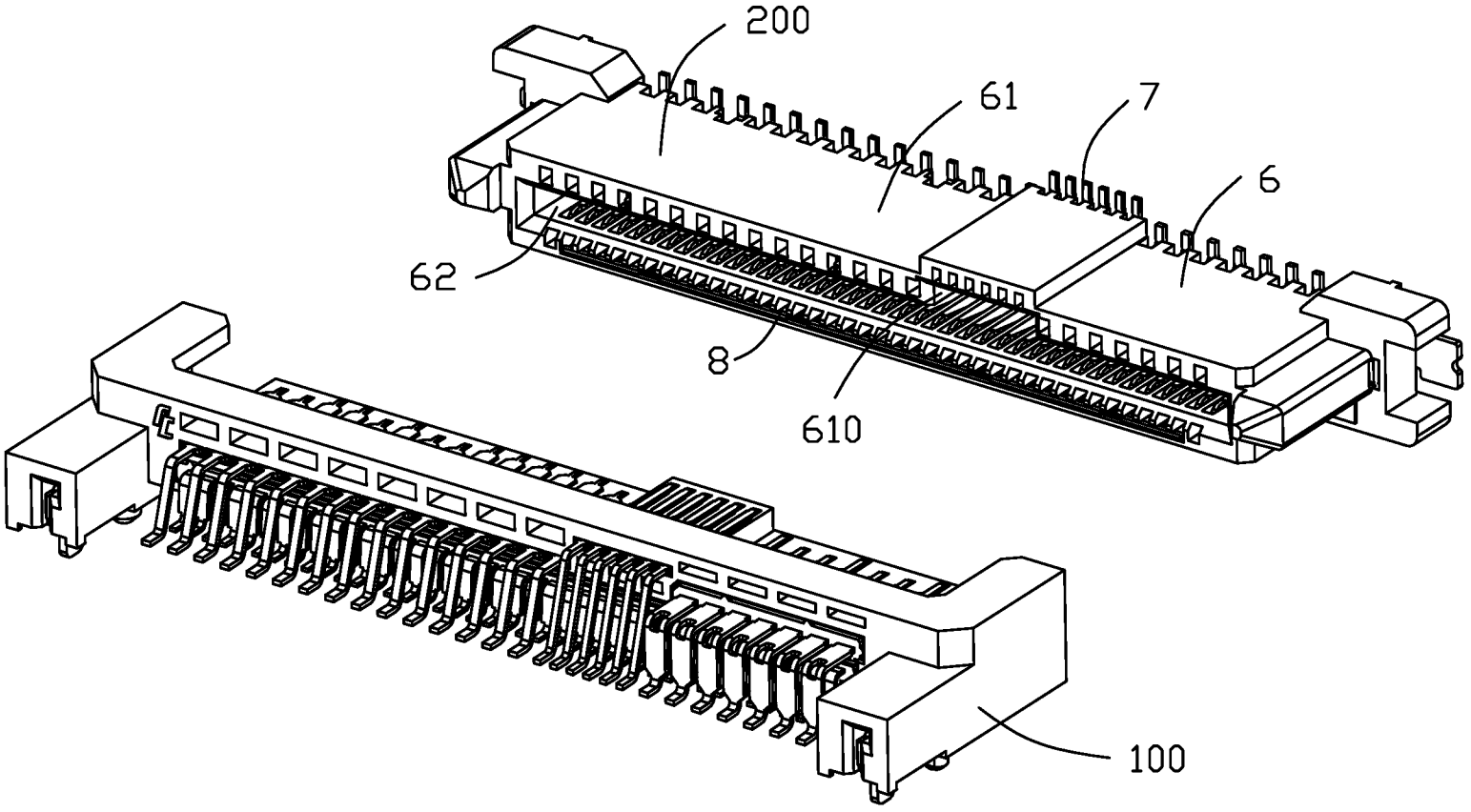
FIG. 4 is another perspective view of the electrical connector assembly of FIG. 3.
Figure 5:
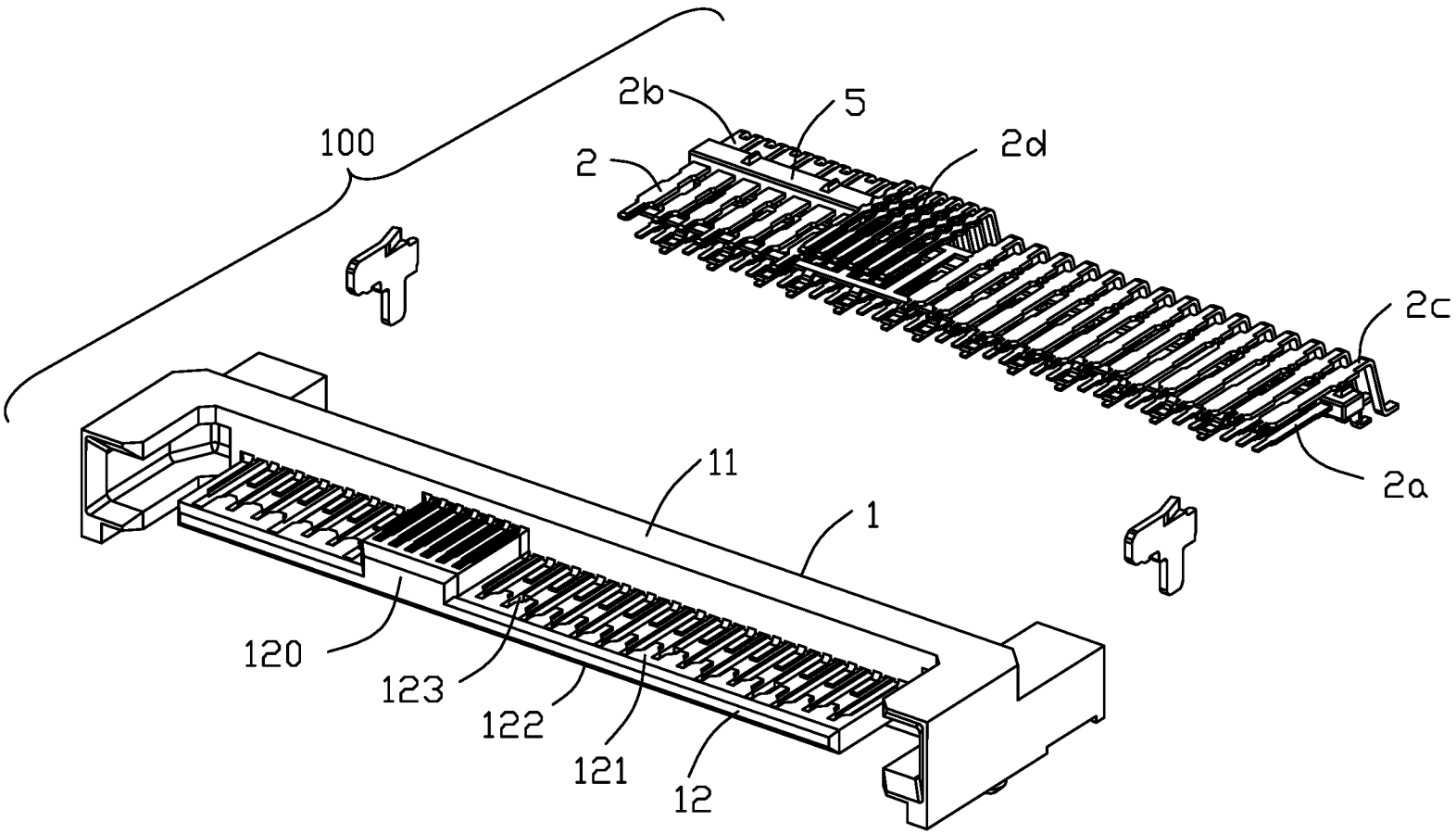
FIG. 5 is an exploded perspective view of the plug connector of the electrical connector assembly of FIG. 1.
Figure 6:
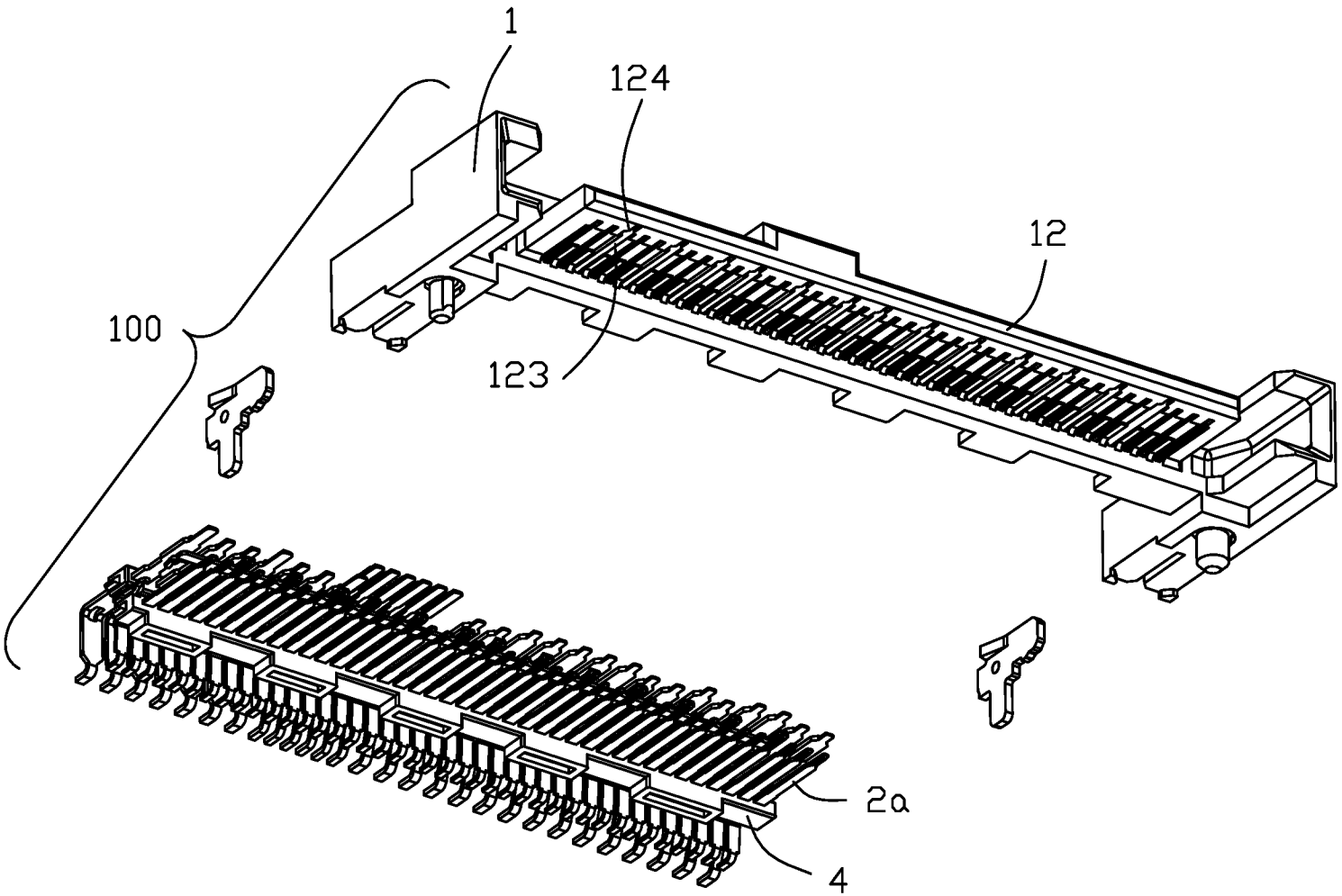
FIG. 6 is another exploded perspective view of the plug connector of the electrical connector assembly of FIG. 5.
Figure 7:
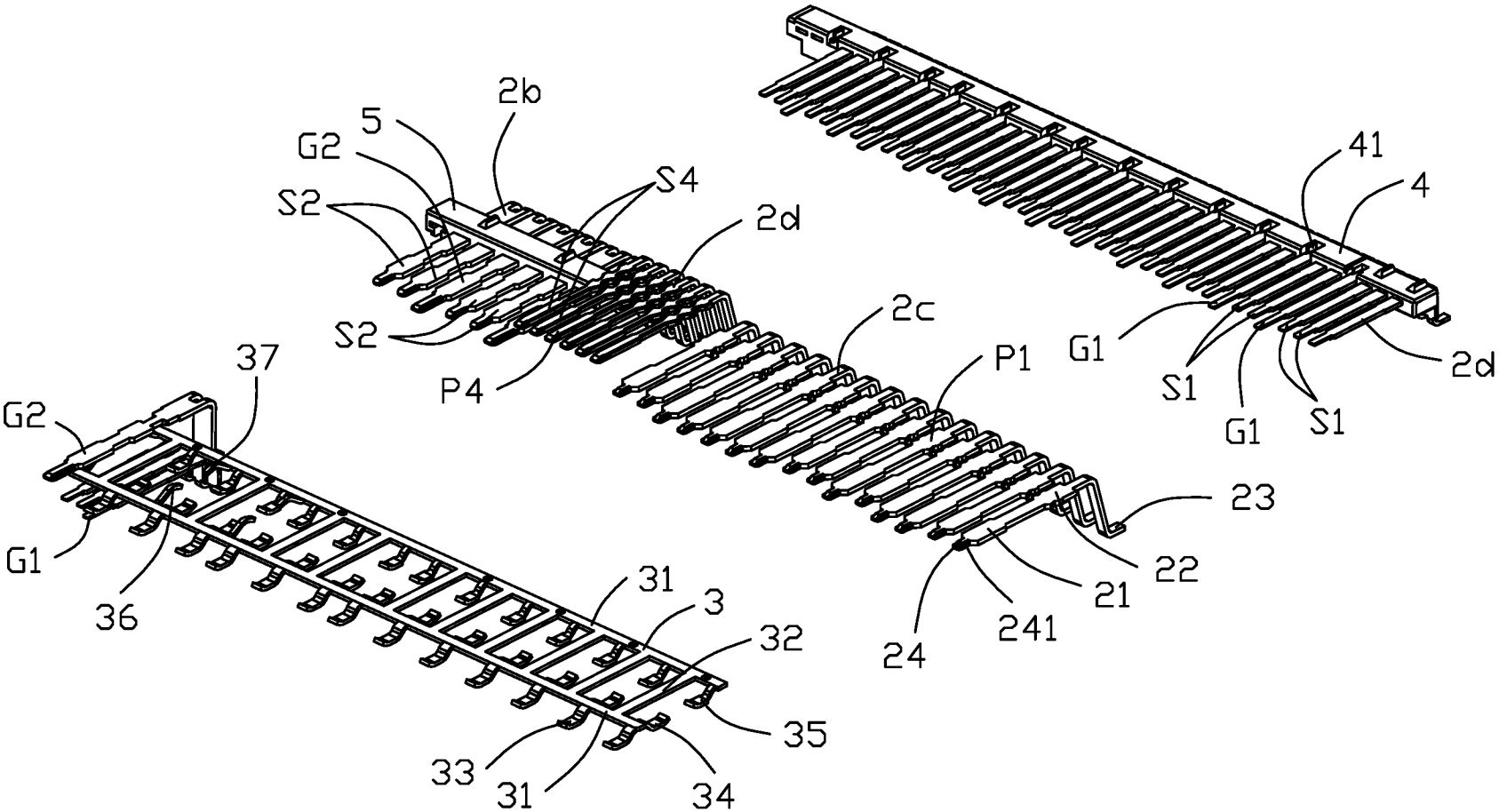
FIG. 7 is a further exploded perspective view of the plug connector of the electrical connector assembly of FIG. 5 without showing the plug housing.
Figure 8:
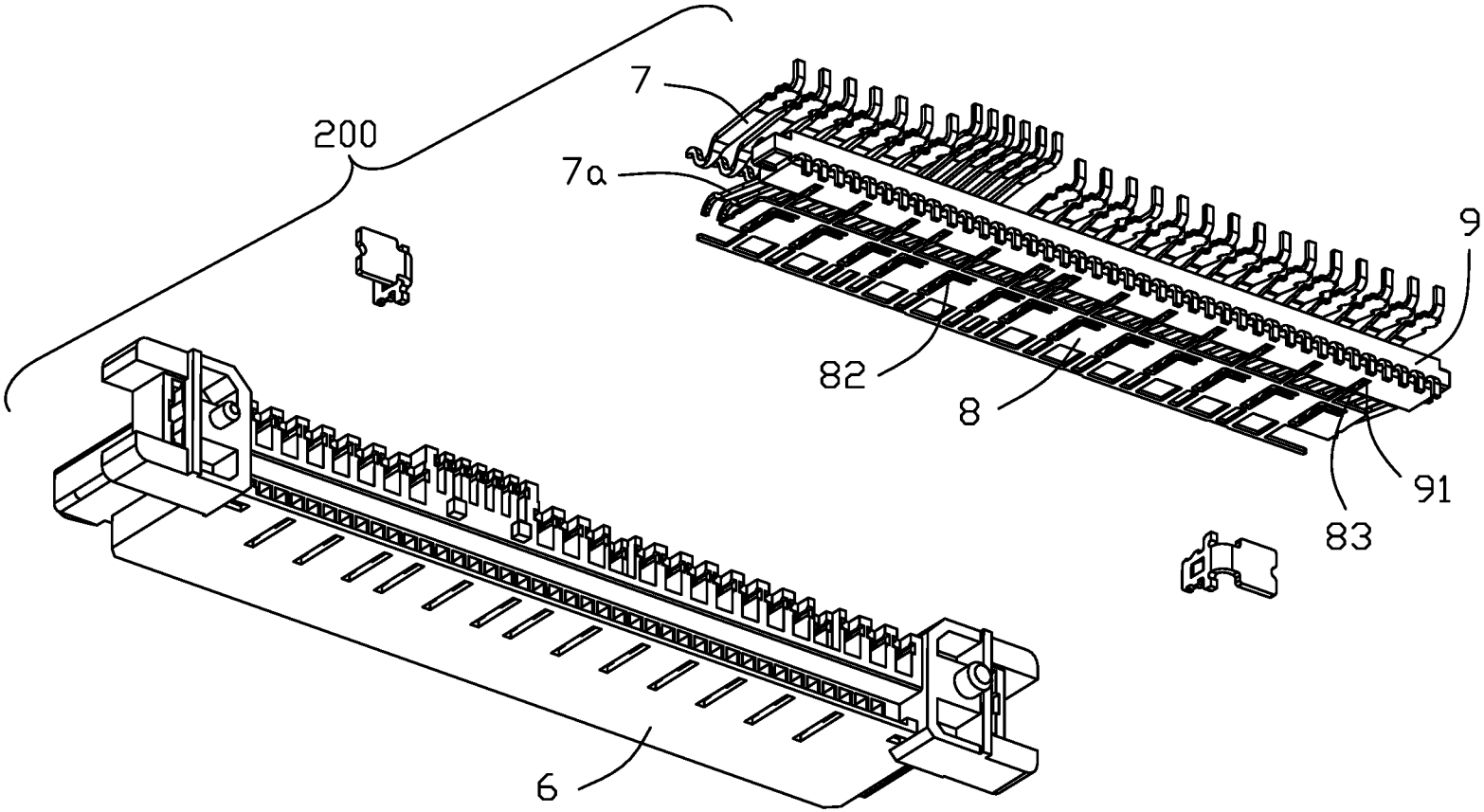
FIG. 8 is an exploded perspective view of the receptacle connector of the electrical connector assembly of FIG. 1.
Figure 9:
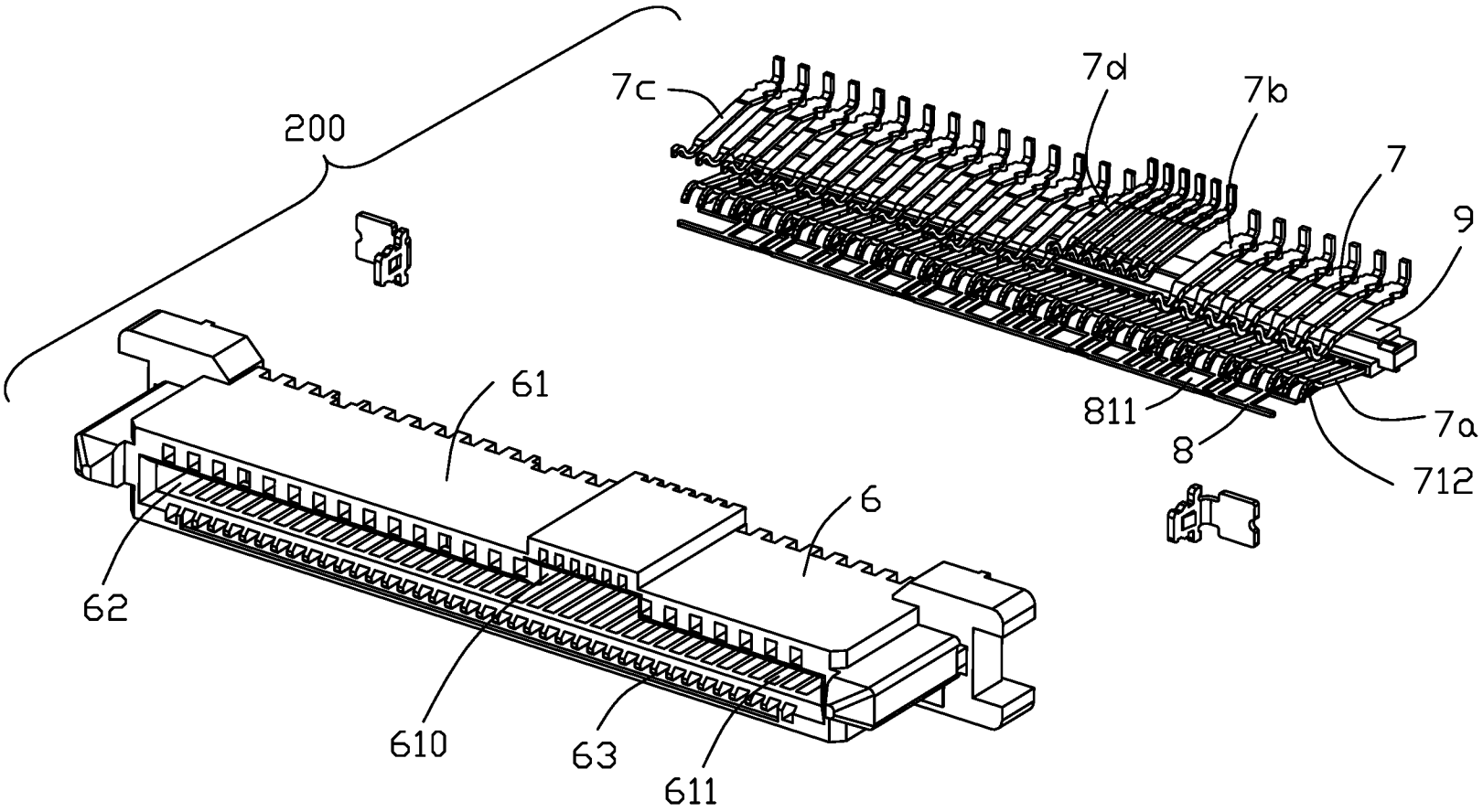
FIG. 9 is another exploded perspective view of the receptacle connector of the electrical connector assembly of FIG. 8.
Figure 10:
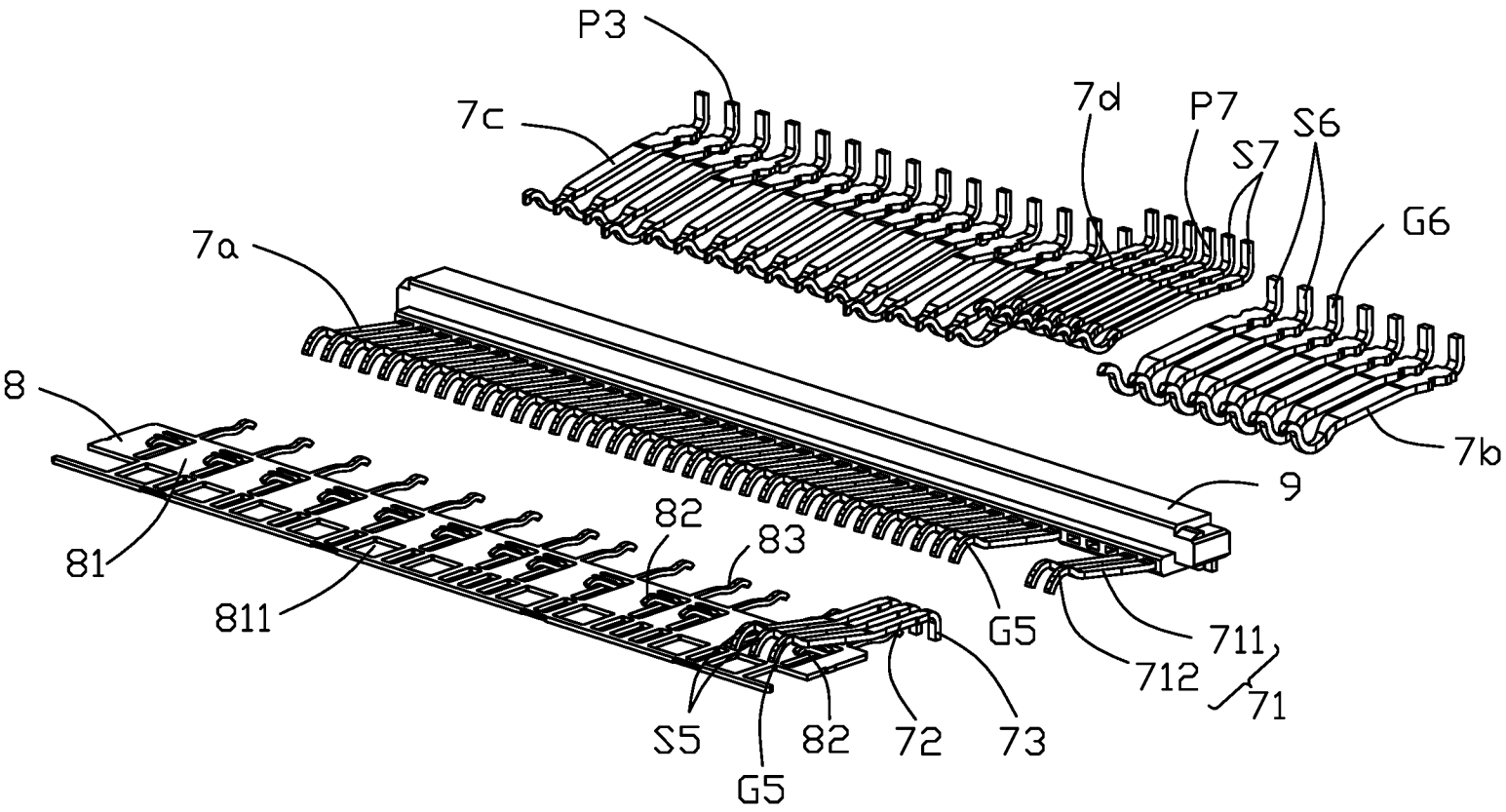
FIG. 10 is a further exploded perspective view of the receptacle connector of the electrical connector assembly of FIG. 8 without showing the receptacle housing.
Figure 11:
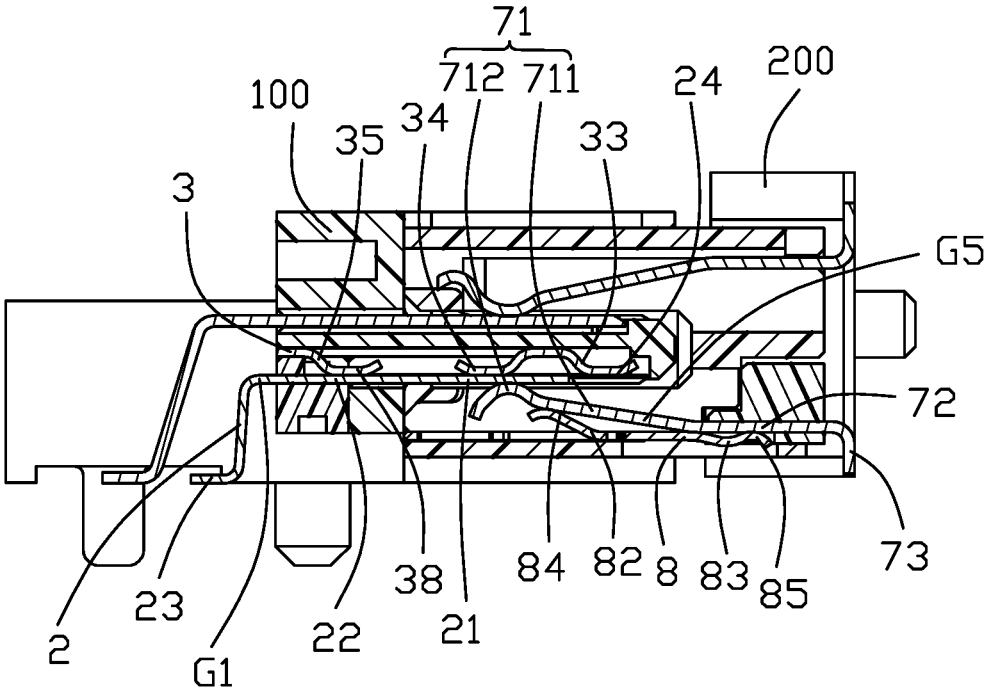
FIG. 11 is a cross-sectional view of the electrical connector assembly of FIG. 1 along line 11-11.
Figure 12:
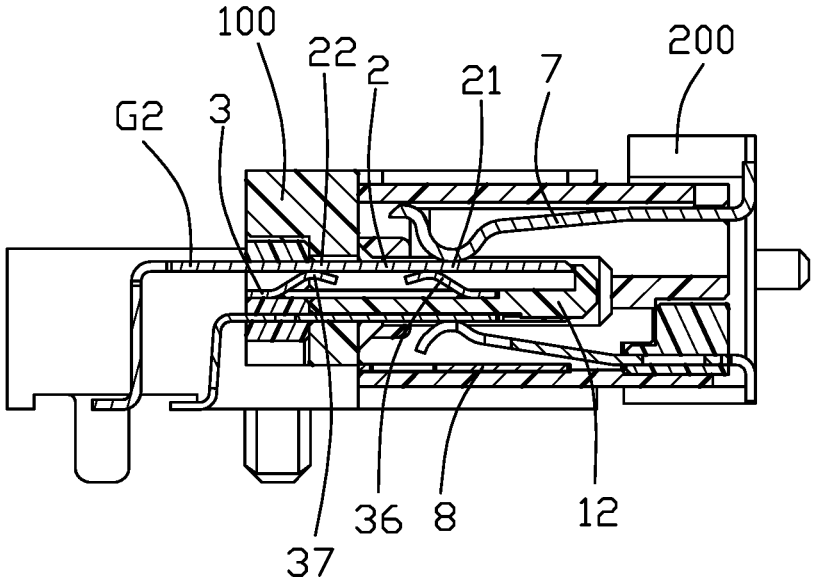
FIG. 12 is a cross-sectional view of the electrical connector assembly of FIG. 1 along line 12-12.

Referring to FIGS. 1-12, an electrical connector assembly includes a plug connector 100 and a receptacle connector 200 adapted to be mated with each other. The plug connector 100 includes an insulative plug housing 1, a plurality of plug contacts 2, a plug grounding bar 3, an insulative bar 4 and an insulative block 5. The plug housing 1 includes a base 11 and the tongue 12 forwardly extending from the base 11. The tongue 12 includes an upper surface 121 and a lower surface 122 opposite to each other. The key 120 is formed on the upper surface 121. A plurality of passageways 123 are formed in the upper surface 121 and the lower surface 122. The contact 2 includes a contacting section 21 exposed upon the tongue 12, a tail section 23 exposed outside of the housing 1, a retaining section 23 between the contacting section 21 and the tail section 23. A reduced section 24 is formed in front of the contacting section 21. The reduced section 24 has two steps 241 on two sides, and the tongue 12 forms the corresponding platform 124 to abut against the steps 241 for holding the contact 2 in position.

The contacts 2 include a first set of contacts 2*a* exposed upon the lower surface 122, a second set of contacts 2*b* exposed upon the upper surface 121 by one side of the key 120, a third set of contacts 2*c* exposed upon the upper surface 121 by the other side of the key 120, and a fourth set of contacts 2*d* upon the upper surface 121 on the key 120. The first set of contacts 2*a* include differential pair contacts 51 and a plurality of grounding contacts G1 alternately arranged with each other as well as the differential pair contacts S2 and the grounding contacts G2 of the second set of contacts 2*b* and the differential pair contacts S4 and the grounding contacts G4 of the fourth set of contacts 2*d*. The third set of contacts 2*c* include the power contacts P1.

The grounding bar 3 is locate between the upper surface 121 and the lower surface 122, and forwardly assembled into the housing 1 from a rear side of the housing 1. The grounding bar 3 includes a pair of poles 31 and a plurality of bridges 32 therebetween, and a plurality of first fingers 33, second finger 34 and third fingers 35 wherein each first finger is aligned with one corresponding second finger 34 and one third finger 35 in the front-to-back direction, and all first finger 33, second finger 34 and third finger 35 are mechanically and electrically connected with one corresponding grounding contact G1. In detail, the first finger 33 contacts the reduced section 24, the second finger contacts the contacting section 21 and the third finger 35 contacts the retaining section 22. Each of the first finger 33, the second finger 34 and the third finger 35 has an abutting section 38 for contacting the reduced section 24, the contacting section 21 and the retaining section 22 of the same grounding contact G1.

The grounding bar 3 further includes a fourth finger 36 and a fifth finger 37 aligned with each other in the front-to-back direction and commonly contacting one grounding contact G2. Via these five fingers, the grounding contacts G1 and the grounding contact G2 results in a loop for enhancing grounding effect. A width of the fourth finger 36 and the fifth finger 37 is smaller than that of the first finger 33, the second finger 34 and the third finger 35.

The first set of contacts 2*a* are insert-molded with the insulative bar 4 to form a contact module which is inserted into the housing 1 from a rear side of the housing 1. The insulative bar 4 forms a plurality of openings 41 so as to allow the corresponding third fingers 35 to extend therethrough for contacting the corresponding grounding contacts G1. Similarly, the second set of contacts 2*b* are insert-molded with the insulative block 5 which is assembled into the housing 1 from the back. The grounding bar 30 is assembled into the housing 1 from the back and sandwiched between the insulative bar 4 and the insulative block 5. Different from the first set of contacts 2*a* and the second set of contacts 2*b* retained to the housing via assistance of the insulative bar 4 and the insulative block 5, the third set of contacts 2*c* and the fourth set of contacts 2*d* are equipped with barbs and inserted into the corresponding passageways 123 for retention.

The receptacle connector 200 includes an insulative (receptacle) housing 6, a plurality of receptacle contacts 7, a receptacle grounding bar 8 and the insulator 9. The housing 6 includes opposite two side walls 61 and an elongated mating slot 62 for receiving the tongue 12 of the plug connector 100. Each side wall 61 includes a plurality of passages 611 for communicate with the mating slot 62. The upper side wall further forms a recess 610 to receive the key 120 of the plug connector 100. All contacts 7 are deflectable and forwardly assembled into the housing 6. Each contact 7 includes a soldering section 73 exposed outside of the housing 6, a deflectable mating/contacting section 71 opposite to the soldering section 73, and a retaining section 72 connected therebetween. The mating section 71 includes an arm 711 extending into the corresponding passage 611, and a curved portion 712 for contacting the contacting section 21 of the plug contact 2.

The contacts 7 include the a first group of contacts 7*a* located at the lower side wall 61, a second group of contacts 7*b* located in the upper side wall 61 by one side of the recess 610, a third group of contacts 7*c* located in the upper side wall 61 by the other side of the recess 610, and a fourth group of contacts located in the upper side wall 61 and in the recess 610. The first group of contacts 7*a* are adapted to be mated with the first set of contacts 2*a*, and include the differential pair contacts S5 and the grounding contacts G5 alternated arranged with each other in the transverse direction, The second group of contacts 7*b* are adapted to be mated with the second set of contacts 2*b*, and include a plurality of differential pair contacts S6 and the grounding contacts G6 alternated with each other. The third group of contacts 7*c* are adapted to be mated with the third set of contacts 2*c*, and include a plurality of power contacts P3. The fourth group of contacts 7*d* are adapted to be mated with the fourth set of contacts 2*d*, and include a plurality of differential pair contacts S7 and the grounding contacts G7. Different from the plug connector 100 whose grounding contacts are longer than the signal contacts, in the receptacle connector 200, the corresponding differential signal contacts and grounding contacts have the same length.

The side wall 61 includes a slit 63, and the grounding bar 8 is assembled into the slit 63 from the back. The grounding bar 8 includes a main body 6 received within the slit 63, a plurality of first tangs 82 abutting against the contacting sections 71 of the grounding contacts G5, and a plurality of second tangs 83 abutting against the retaining sections 72 of the grounding contacts G5. Similar to the plug connector 100, the first tangs 82 and the second tangs 83 may enhance the grounding effect of the grounding contact G5 to equalize the electromotive force along the whole grounding contact. The first tang 82 is received within the passage 611 and abuts against the arm 711 of the grounding contact G5. During mating, the first tang 82 may support the arm 711 to prevent the excessive deflection of the arm 711 of the grounding contact G5. In this embodiment, the first tang 82 and the second tang 83 form the abutting sections 84, 85 to support the corresponding arm 711 wherein the first tang 82 forms an L-shaped configuration to increase the force arm. The main body 81 of the grounding bar 8 rearwardly extends beyond the mating section 71. The main body 81 forms a plurality of openings 811 for accommodating outwardly deflected curved portion 712 of the contact 7 for preventing interference therebetween during mating.

The differential pair contacts S5 and the grounding contacts G5 are insert-molded within the insulator 9 to form a contact module. The insulator 9 is assembled into the housing 6 from the back. The insulator 9 forms a plurality of openings 91 to expose the retaining sections 72 of the grounding contacts G5 and allow the second tangs 83 to extend therethrough for reaching the corresponding retaining sections 72 of the grounding contacts G5.

The invention provides multiple contacting points between the grounding bar and the respective grounding contacts to keep the constant impedance along the contact. The spring finger or spring tang may provide support for the corresponding grounding contact. The insulative bar and the insulator provide the opening to expose the corresponding grounding contacts and to allow the spring fingers and spring tangs to extend therethrough for reach the corresponding grounding contacts. In the plug connector, the grounding bar 3 may create a loop via assistance of the fingers 33, 34, 35, 36 and 37.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A plug connector comprising:

an insulative housing including a base, and a tongue forwardly extending from the base in a front-to-back direction and defining opposite upper surface and lower surface in a vertical direction perpendicular to the front-to-back direction;

two rows of passageways formed in the tongue and respectively exposed upon the opposite upper and lower surfaces of the tongue;

a first set of contacts respectively disposed in the corresponding passageways and exposed to the lower surface, said first set of contacts insert-molded with an insulative bar and including a plurality of differential pair contacts and grounding contacts;

a second set of contacts respectively disposed in the corresponding passageways and exposed to the upper surface, said second set of contacts insert-molded with an insulative block and including a plurality of differential pair contacts and grounding contacts; and a metallic grounding bar disposed between the upper surface and the lower surface and sandwiched between the insulative bar and the insulative block in the vertical direction; wherein said metallic bar includes a plurality of first fingers mechanically and electrically connecting to the corresponding grounding contacts of the first set of contacts, and a plurality of second fingers mechanically and electrically connecting to the corresponding grounding contacts of the second set of contacts.

2. The plug connector as claimed in claim 1, wherein each grounding contact of the first set of contact is connected by three first fingers at three different positions along the front-to-back direction.

3. The plug connector as claimed in claim 2, wherein each contact includes a front contacting section with a reduced section at a front tip, a middle retaining section and a rear soldering section, and the three first fingers respectively abut against the reduced section, the contacting section and the retaining section.

4. The plug connector as claimed in claim 3, wherein the insulative bar forms a plurality of openings to expose the retaining sections of the corresponding grounding contacts so as to allow the corresponding first finger to extend therethrough for contacting the retaining section.

5. The plug connector as claimed in claim 2, wherein the grounding bar includes a pair of poles each extending in a transverse direction perpendicular to both the vertical direction and the front-to-back direction, and a plurality of bridges linked between the pair of poles and extending along the front-to-back direction to cooperate with the pair of poles to form a plurality openings, and the first fingers extending from the pair of poles within the corresponding openings.

6. The plug connector as claimed in claim 1, further including a third set of contacts disposed in the corresponding passageways exposed in the upper surface, wherein the third set of contacts are respectively retained to the housing via barbs.

7. A plug connector comprising:

an insulative housing including a base, and a tongue forwardly extending from the base in a front-to-back direction and defining opposite upper surface and lower surface in a vertical direction perpendicular to the front-to-back direction;

at least one row of passageways formed in the tongue and respectively exposed upon one of the upper and lower surfaces of the tongue;

a first set of contacts respectively disposed in the corresponding passageways and exposed to the one of the upper surface and the lower surface, said first set of contacts including a plurality of differential pair contacts and grounding contacts; and a metallic grounding bar disposed between the upper surface and the lower surface in the vertical direction, a plurality of spring fingers extending from the grounding bar; wherein each grounding contact is mechanically and electrically connected with three first fingers at three different positions in the front-to-back direction.

8. The plug connector as claimed in claim 7, wherein each of said first set of contacts including a front contacting section with a reduced section at a front tip, a middle retaining section and a rear soldering section in the front-to-back direction, and the three first fingers abut against the reduced section, the contacting section and the retaining section.

9. The plug connector as claimed in claim 7, wherein the grounding bar includes a pair of poles each extending in a transverse direction perpendicular to both the vertical direction and the front-to-back direction, and a plurality of bridges linked between the pair of poles and extending along the front-to-back direction to cooperate with the pair of poles to form a plurality openings, and the first fingers extending from the pair of poles within the corresponding openings.

10. An electrical connector assembly comprising:

a plug connector including an insulative plug housing and a plurality of plug contacts retained in the plug housing, the plug contacts including plug grounding contacts, each of the plug contact including an exposed stationary contacting section;

a plug grounding bar retained in the plug housing and including a plurality of first fingers respectively abutting against the stationary contacting section of the plug grounding contact; and a receptacle connector including an insulative receptacle housing and a plurality of receptacle contacts retained in the receptacle housing, the receptacle contacts including receptacle grounding contacts, each of the receptacle contact including an exposed deflectable contacting section;

a receptacle grounding bar retained in the receptacle housing and including a plurality of second fingers respectively abutting against the deflectable contacting section of the receptacle grounding contact; wherein when mated, the deflectable contacting section of the receptacle contact is mated with the stationary contacting section of the plug contact so as to have the first finger cooperate with the corresponding second finger to commonly sandwich the deflectable contacting section of the receptacle contact and the stationary contacting section of the plug contact therebetween.

* * * * *